US011808519B2

(12) United States Patent
Sekiguchi et al.

(10) Patent No.: US 11,808,519 B2
(45) Date of Patent: Nov. 7, 2023

(54) DRYING SYSTEM AND METHOD FOR MANUFACTURING COATED METAL PLATE

(71) Applicant: JFE STEEL CORPORATION, Tokyo (JP)

(72) Inventors: Tomohiro Sekiguchi, Tokyo (JP); Koji Iwata, Tokyo (JP); Shino Katayama, Tokyo (JP); Koki Sugiyama, Tokyo (JP); Yuta Sakata, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 206 days.

(21) Appl. No.: 17/441,134

(22) PCT Filed: Mar. 16, 2020

(86) PCT No.: PCT/JP2020/011321
§ 371 (c)(1),
(2) Date: Sep. 20, 2021

(87) PCT Pub. No.: WO2020/203204
PCT Pub. Date: Oct. 8, 2020

(65) Prior Publication Data

US 2022/0187017 A1 Jun. 16, 2022

(30) Foreign Application Priority Data

Mar. 29, 2019 (JP) ..... 2019-065581

(51) Int. Cl.
*F26B 21/02* (2006.01)
*F26B 3/04* (2006.01)
*F26B 21/08* (2006.01)

(52) U.S. Cl.
CPC ..... *F26B 21/028* (2013.01); *F26B 3/04* (2013.01); *F26B 21/08* (2013.01)

(58) Field of Classification Search
CPC ..... F26B 21/028; F26B 3/04; F26B 21/08
(Continued)

(56) References Cited

U.S. PATENT DOCUMENTS 1,173,171 A * 2/1916 Casey et al. ..... F26B 21/028 34/562
2,725,224 A * 11/1955 Pierce ..... F26B 23/02 34/224
(Continued)

FOREIGN PATENT DOCUMENTS

CN 101855026 A 10/2010
CN 103168209 B 5/2015
(Continued)

OTHER PUBLICATIONS

Jan. 28, 2021 Office Action issued in Taiwanese Patent Application No. 109109880.
(Continued)

*Primary Examiner* — Stephen M Gravini
(74) *Attorney, Agent, or Firm* — Oliff PLC

(57) ABSTRACT

A drying system includes: drying furnaces connected in series; an air supply system including an air supply pipe, the air supply system being configured to supply dry air into the furnaces, and an air exhaust system including an air exhaust pipe, the air exhaust system being configured to exhaust wet air in the furnaces, wherein the air supply system and the air exhaust system are being alternately connected between the drying furnaces; a first flow rate regulation valve provided to the air supply system; and a second flow rate regulation valve provided to the air exhaust system.

8 Claims, 1 Drawing Sheet

(58) Field of Classification Search
USPC ..... 34/523
See application file for complete search history.

(56) References Cited

U.S. PATENT DOCUMENTS

| | | | | |
|---|---|---|---|---|
| 4,198,273 | A * | 4/1980 | Dudek | C10L 9/08 432/106 |
| 4,982,511 | A * | 1/1991 | Frei | C12C 1/15 34/434 |
| 9,874,397 | B1 * | 1/2018 | Ball, Jr. | F26B 21/022 |
| RE48,227 | E * | 9/2020 | Ball, Jr. | F26B 21/028 |
| 2002/0038521 | A1 | 4/2002 | Speck | |
| 2015/0086866 | A1 | 3/2015 | Park et al. | |
| 2018/0216886 | A1 | 8/2018 | Iglauer et al. | |
| 2020/0024476 | A1 * | 1/2020 | Satou | B05D 7/14 |
| 2020/0166275 | A1 | 5/2020 | Iglauer et al. | |
| 2021/0381767 | A1 | 12/2021 | Iglauer et al. | |
| 2022/0090287 | A1 * | 3/2022 | Kato | F26B 3/04 |
| 2022/0187017 | A1 * | 6/2022 | Sekiguchi | F26B 21/12 |

FOREIGN PATENT DOCUMENTS

| | | | | |
|---|---|---|---|---|
| CN | 107552351 | A | 1/2018 | |
| CN | 107667270 | A | 2/2018 | |
| CN | 208427319 | U | 1/2019 | |
| EP | 2218519 | A1 | 8/2010 | |
| EP | 3951299 | A1 * | 2/2022 | B05B 16/20 |
| JP | S57-190668 | A | 11/1982 | |
| JP | H02-223789 | A | 9/1990 | |
| JP | H06-142602 | A | 5/1994 | |
| JP | H06-246219 | A | 9/1994 | |
| JP | 2000-197845 | A | 7/2000 | |
| JP | 2002-254012 | A | 9/2002 | |
| JP | 2005-99790 | A | 4/2005 | |
| JP | 2005-262132 | A | 9/2005 | |
| JP | 2011-94930 | A | 5/2011 | |
| JP | 2013-137139 | A | 7/2013 | |
| JP | 2014-184364 | A | 10/2014 | |
| JP | 2015-210031 | A | 11/2015 | |
| JP | WO2020203204 | A1 * | 4/2021 | |
| KR | 10-2013-0127578 | A | 11/2013 | |
| KR | 10-1475429 | B1 | 12/2014 | |
| KR | 20210125082 | A * | 10/2021 | |
| WO | WO-2020203204 | A1 * | 10/2020 | B05B 16/20 |

OTHER PUBLICATIONS

Jun. 16, 2020 International Search Report issued in International Patent Application No. PCT/JP2020/011321.
Jan. 4, 2022 Japanese Office Action issued in Japanese Patent Application No. 2020-535260.
Mar. 28, 2022 Extended European Search Report issued in European Application No. 20785280.7.
Apr. 20, 2022 Office Action with Search Report issued in Chinese Patent Application No. 202080023659.2.
Jul. 20, 2023 Office Action issued in Korean Patent Application No. 10-2021-7029462.

* cited by examiner

DRYING SYSTEM AND METHOD FOR MANUFACTURING COATED METAL PLATE

FIELD

The present invention relates to a drying system including a plurality of drying furnaces connected in series and a method for manufacturing a coated metal plate.

BACKGROUND

When a metal plate to which a coating material containing a solvent such as water is applied, is dried in a drying furnace, control of the dew point in the drying furnace is necessary because water evaporates in the furnace. A known method for controlling the dew point in a single drying furnace is described in Patent Literature 1. Specifically, the method described in Patent Literature 1 reduces occurrence of condensation in the drying furnace by controlling the atmospheric temperature in the drying furnace based on the dew point in the drying furnace.

CITATION LIST

Patent Literature

Patent Literature 1: Japanese Patent Application Laid-open No. 2005-262132

SUMMARY

Technical Problem

The method described in Patent Literature 1 needs to install a fan for supplying and exhausting air, to the single drying furnace so as to control the atmospheric temperature. If the method of Patent Literature 1 is used to control the dew point of a drying system with a plurality of drying furnaces connected in series, the facility is inevitably expanded with an increase in the number of fans for supplying and exhausting air. To overcome such a problem, respective fans may be installed to an air supply system and an air exhaust system to integrally control the dew points of all the drying furnaces. This structure, however, requires higher performance of the fans and thus has difficulty in appropriately controlling the dew point.

With regard to a drying furnace using induction heating (IH), when the amount of heat is inadequate with a single drying furnace, a plurality of drying furnaces connected with one another are sometimes used as one drying furnace. A drying furnace adopting burner heating may also use a plurality of connected drying furnaces each having a smaller furnace length, with the intention to strictly control the temperature at each place. Since water that evaporates from a dried object stays in the drying furnace, an air supply system for supplying dry air and an air exhaust system for exhausting wet air are needed for the furnace. A drying furnace, such as an IH drying furnace, that is small in size and receives a large amount of heat input has relatively high water content, because of a large amount of evaporation per unit area. In a heating system in which heat is applied from a metal plate side, such as IH, either the atmospheric temperature or the wind speed of the atmosphere is not necessarily raised to increase the temperature of the metal plate. In this method, however, condensation easily occurs, and control of the dew point is therefore more important. The dew point is increased with water staying in the furnace, as a result of inappropriate management of the amount of air supplied and exhausted from the drying furnace. An increase in the dew point causes condensation in the furnace, which impairs the quality of the dried object and the finished product.

From the above viewpoint, it is an object of the present invention to provide a drying system that is able to appropriately control the dew points of a plurality of drying furnaces while avoiding expansion of the facility. In addition, it is another object of the present invention to provide a method for manufacturing a coated metal plate that allows manufacturing of a high-quality coated metal plate.

Solution to Problem

To solve the problem and achieve the object, a drying system including drying furnaces connected in series, according to the present invention includes: an air supply system configured to supply dry air into furnaces and an air exhaust system configured to exhaust wet air in the furnaces, the air supply system and the air exhaust system being alternately connected between the drying furnaces; and respective flow rate regulation valves provided to the air supply system and the air exhaust system.

Moreover, the drying system according to the present invention further includes a controller configured to, when a dew point in a drying furnace becomes higher than a reference dew point, open only flow rate regulation valves provided to an air supply system and an air exhaust system closest to the drying furnace experiencing an increase in the dew point.

Moreover, in the drying system according to the present invention, the controller is configured to control an opening of the flow rate regulation valve to make water content in the drying furnace lower than saturation water content at a wall temperature in the drying furnace.

Moreover, a method for manufacturing a coated metal plate according to the present includes a step of manufacturing a coated metal plate using the drying system according to the present invention.

Advantageous Effects of Invention

The drying system according to the present invention is advantageous in appropriately controlling the dew points of a plurality of drying furnaces while avoiding expansion of the facility. The method for manufacturing a coated metal plate according to the present invention allows manufacturing of a high-quality coated metal plate.

DESCRIPTION OF EMBODIMENTS

A drying system as an embodiment of the present invention will now be described in detail with reference to the drawings.

Figure 1:
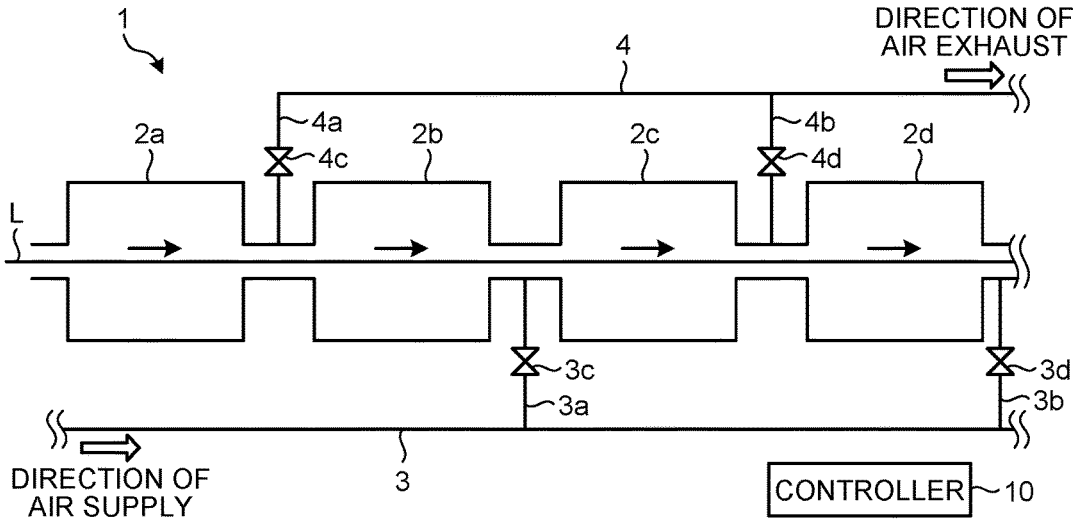
FIG. 1 is a schematic drawing that illustrates the overall configuration of a drying system as an embodiment of the present invention.

FIG. 1 is a schematic drawing that illustrates the overall configuration of a drying system as an embodiment of the present invention. As illustrated in FIG. 1, a drying system 1 as an embodiment of the present invention is a system to dry an object to be dried, such as a coated metal strip, that is conveyed along a conveyor line L. The drying system 1 includes a plurality of drying furnaces 2*a* to 2*d* connected in series along the conveyor line L, and an air supply system 3 to supply dry air into a furnace and an exhaust system 4 to exhaust wet air in the furnace, the air supply system and the air exhaust system being alternately connected between furnaces. A method for manufacturing a coated metal plate with the drying system 1 as an embodiment of the present invention allows manufacturing of a coated metal plate, by applying a coating material containing a solvent, such as water, to a metal plate using a coating device (not illustrated), conveying the metal plate into the drying system 1 along the conveyor line L and drying, and then cooling using, for example, a cooling device (not illustrated). Processes of degreasing and pickling are added as necessary to clean the metal plate before coating. Various nonlimiting methods of coating are applicable, such as coating using a roll coater, a spray coater, and a bar coater. A metal plate feeder and a metal plate winder may be preferably installed at the entrance and the exit of the conveyor line to enable continuous operation of the metal plate.

An air supply system 3 is connected between a drying furnace 2*b* and a drying furnace 2*c* through an air supply pipe 3*a* and further connected between a drying furnace 2*d* and a drying furnace subsequent to the drying furnace 2*d* through an air supply pipe 3*b*. The air supply pipe 3*a* and the air supply pipe 3*b* are provided with a flow rate regulation valve 3*c* and a flow rate regulation valve 3*d*, respectively, for regulating the flow rate of dry air supplied into the furnaces.

An air exhaust system 4 is connected between a drying furnace 2*a* and the drying furnace 2*b* through an air exhaust pipe 4*a* and further connected between the drying furnace 2*c* and the drying furnace 2*d* through an air exhaust pipe 4*b*. The air exhaust pipe 4*a* and the air exhaust pipe 4*b* are provided with a flow rate regulation valve 4*c* and a flow rate regulation valve 4*d*, respectively, for regulating the flow rate of wet air exhausted from the furnaces.

In use of the drying system 1, control of the water content generated in a furnace per unit time and control of the flow rate of dry air supplied into the furnace are important in controlling the dew point of the furnace. The water content generated in the furnace, however, varies depending on the concentration of a coating material, the thickness of the film, the speed of conveyance, the amount of heat applied to the object to be dried, and the drying rate. Since control of the generated water content considerably affects the quality of the dried object and productivity, such variations depending on the conditions need to be reduced for an efficient reduction in condensation.

From this point of view, the drying system 1 includes a controller 10 implemented by an information processor such as a computer. With the controller 10 controlling the opening of the flow rate regulation valves 3*c*, 3*d*, 4*c*, and 4*d*, the drying system 1 controls the dew point of each furnace. More specifically, since an increase in the flow rate of air (the flow rate of flowing air in the furnace) passing in the drying furnace decreases the dew point, the opening of the flow rate regulation valves 3*c*, 3*d*, 4*c*, and 4*d* are controlled to increase the flow rate of furnace flowing air of a drying furnace having a dew point exceeding a reference value.

In this embodiment, the controller 10 opens the flow rate regulation valves of the air supply system 3 and the air exhaust system 4 adjacent to a drying furnace having a dew point exceeding a reference value and closes other flow rate regulation valves. For example, when the dew point of the drying furnace 2*b* exceeds a reference value, the controller 10 opens only the flow rate regulation valve 3*c* and the flow rate regulation valve 4*c* adjacent to the drying furnace 2*b* and closes other flow rate regulation valves. This operation increases the flow rate of air passing in the drying furnace 2*b*. In this manner, the dew point of each drying furnace can be controlled in a predetermined range.

Figure 2:
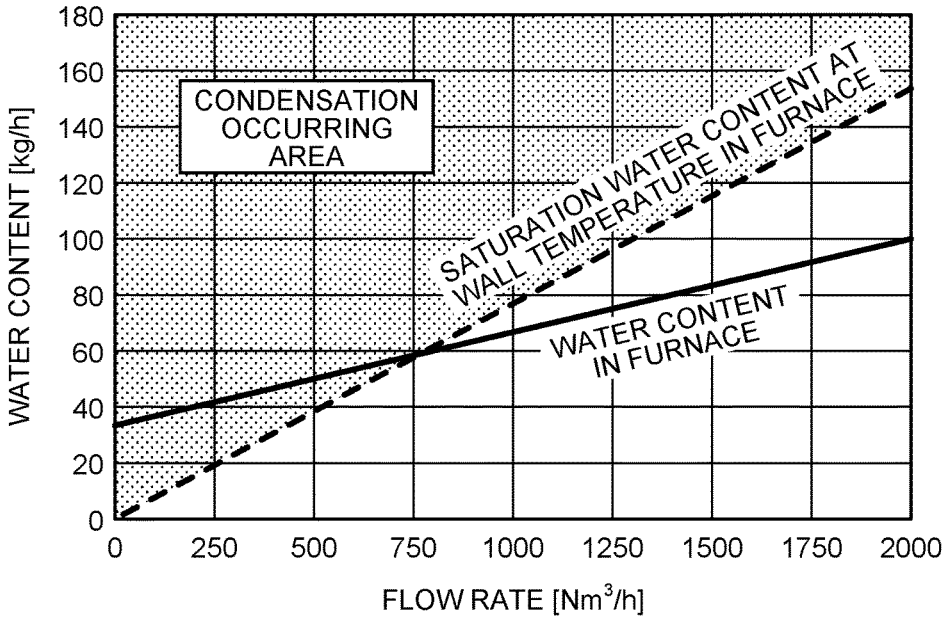
FIG. 2 is a graph that indicates relation between the saturation water content at a wall temperature in a furnace and the water content at the flow rate of air flowing in the furnace.

As illustrated in FIG. 2, condensation occurs in a furnace when the water content in the furnace exceeds the saturation water content at the wall temperature in the furnace. It is therefore preferable that the controller 10 controls the flow rate of furnace flowing air such that the furnace water content does not exceed the saturation water content at the wall temperature in the furnace. This structure can achieve a responsive reduction in occurrence of condensation, in comparison with a method that reduces occurrence of condensation by controlling the temperature.

The dew point of each drying furnace can be automatically and continuously controlled by using a dew point meter that continuously measures the dew point and an automatic flow rate regulation valve. Similar effects can be obtained by having an operator read an indicative value of a spot-check dew point meter on regular basis and manually open or close a flow rate regulation valve.

As is obvious from the above description, the drying system as an embodiment of the present invention includes an air supply system that supplies dry air into a furnace and an air exhaust system that exhausts wet air in the furnace, the air supply system and the air exhaust system being alternately connected between a plurality of drying furnaces, and includes respective flow rate regulation valves provided to the air supply system and the air exhaust system. This drying system does not have to install an air supply pipe and an air exhaust pipe for adjustment based on the dew point of each drying furnace and allows for an efficient reduction in condensation.

An embodiment to which an invention of the present inventors is adopted has been described. Description in the embodiment and the drawings constituting a part of disclosure of the present invention are not intended to limit the present invention. Other embodiments, examples, operational techniques, and others that are made by the skilled person or the like based on this embodiment are all included in the scope of the present invention.

INDUSTRIAL APPLICABILITY

According to the present invention, a drying system can be provided that is able to appropriately control the dew points of a plurality of drying furnaces without having the facility expanded. Furthermore, according to the present invention, a method for manufacturing a coated metal plate that allows manufacturing of a high-quality coated metal plate can be provided.

REFERENCE SIGNS LIST

1 DRYING SYSTEM
2*a*, 2*b*, 2*c*, 2*d* DRYING FURNACE
3 AIR SUPPLY SYSTEM
3*a*, 3*b* AIR SUPPLY PIPE
3*c*, 3*d* FLOW RATE REGULATION VALVE
4 AIR EXHAUST SYSTEM
4*a*, 4*b* AIR EXHAUST PIPE
4*c*, 4*d* FLOW RATE REGULATION VALVE
10 CONTROLLER
L CONVEYOR LINE

The invention claimed is:

1. A drying system comprising:

drying furnaces connected in series;

an air supply system including an air supply pipe, the air supply system being configured to supply dry air into the furnaces, and an air exhaust system including an air exhaust pipe, the air exhaust system being configured to exhaust wet air in the furnaces, wherein the air supply system and the air exhaust system are alternately connected to the series of drying furnaces at positions outside of and between the drying furnaces;

a first flow rate regulation valve provided to the air supply system and the air exhaust system; and a second flow rate regulation valve provided to the air exhaust system.

2. The drying system according to claim 1, further comprising a controller configured to, when a dew point in a drying furnace becomes higher than a reference dew point, open only a first flow rate regulation valve and a second flow rate regulation valve provided respectively to an air supply system and an air exhaust system closest to the drying furnace experiencing the dew point in the drying furnace higher than the reference dew point.

3. The drying system according to claim 2, wherein the controller is configured to control an opening of the first flow rate regulation valve and the second flow rate regulation valve to make water content in the drying furnace lower than saturation water content at a wall temperature in the drying furnace.

4. A method for manufacturing a coated metal plate, the method comprising manufacturing a coated metal plate using a drying system including:

drying furnaces connected in series;

an air supply system including an air supply pipe, the air supply system being configured to supply dry air into the furnaces, and an air exhaust system including an air exhaust pipe, the air exhaust system being configured to exhaust wet air in the furnaces, wherein the air supply system and the air exhaust system are alternately connected to the series of drying furnaces at positions outside of and between the drying furnaces;

a first flow rate regulation valve provided to the air supply system; and a second flow rate regulation valve provided to the air exhaust system.

5. The method according to claim 4, wherein the drying system further includes a controller configured to, when a dew point in a drying furnace becomes higher than a reference dew point, open only a first flow rate regulation valve and a second flow rate regulation valve provided respectively to an air supply system and an air exhaust system closest to the drying furnace experiencing in the dew point in the drying furnace higher than the reference dew point.

6. The method according to claim 5, wherein the controller is configured to control an opening of the first flow rate regulation valve and the second flow rate regulation valve to make water content in the drying furnace lower than saturation water content at a wall temperature in the drying furnace.

7. The drying system according to claim 1, wherein the drying furnaces are connected in series along a conveyor line, and the air supply system and the air exhaust system are connected to the series of furnaces at alternating positions in between the drying furnaces along the conveyor line.

8. The method according to claim 4, wherein the drying furnaces are connected in series along a conveyor line, and the air supply system and the air exhaust system are connected to the series of furnaces at alternating positions in between the drying furnaces along the conveyor line.

* * * * *